US012098341B2

(12) United States Patent
Matsumura

(10) Patent No.: US 12,098,341 B2
(45) Date of Patent: Sep. 24, 2024

(54) LUBRICANT BASE OIL

(71) Applicant: KAO CORPORATION, Tokyo (JP)

(72) Inventor: Kazuhiro Matsumura, Wakayama (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 18/034,636

(22) PCT Filed: Nov. 10, 2021

(86) PCT No.: PCT/JP2021/041322

§ 371 (c)(1),
(2) Date: Apr. 28, 2023

(87) PCT Pub. No.: WO2022/102651

PCT Pub. Date: May 19, 2022

(65) Prior Publication Data

US 2023/0383208 A1 Nov. 30, 2023

(30) Foreign Application Priority Data

Nov. 12, 2020 (JP) ..... 2020-188749

(51) Int. Cl.

| | |
|---|---|
| ***C10M 105/38*** | (2006.01) |
| ***C10N 20/02*** | (2006.01) |
| ***C10N 30/02*** | (2006.01) |
| ***C10N 30/08*** | (2006.01) |
| ***C10N 70/00*** | (2006.01) |

(52) U.S. Cl.

CPC .. *C10M 105/38* (2013.01); *C10M 2207/2835* (2013.01); *C10M 2207/2845* (2013.01); *C10N 2020/02* (2013.01); *C10N 2030/02* (2013.01); *C10N 2030/08* (2013.01); *C10N 2070/00* (2013.01)

(58) Field of Classification Search

CPC ..... C10M 105/38; C10M 2207/2835; C10M 2207/2845; C10N 2020/02; C10N 2030/02; C10N 2030/08; C10N 2070/00

See application file for complete search history.

(56) References Cited

U.S. PATENT DOCUMENTS

| | | | |
|---|---|---|---|
| 2005/0145823 | A1 | 7/2005 | Yamada et al. |
| 2012/0322706 | A1 | 12/2012 | Matsumoto et al. |
| 2017/0277529 | A1 | 9/2017 | Inokuma |
| 2020/0063057 | A1 | 2/2020 | Miyazaki |
| 2022/0064559 | A1 | 3/2022 | Miyazaki et al. |

FOREIGN PATENT DOCUMENTS

| | | | | |
|---|---|---|---|---|
| CN | 101892112 | A | | 11/2010 |
| CN | 105985822 | A | | 10/2016 |
| CN | 110746294 | A | * | 2/2020 |
| EP | 0 632 124 | A1 | | 1/1995 |
| JP | 7-145396 | A | | 6/1995 |
| JP | 7-506869 | A | | 7/1995 |
| JP | 8-302373 | A | | 11/1996 |
| JP | 2005-171233 | A | | 6/2005 |
| JP | 2011-162766 | A | | 8/2011 |
| JP | 2012-515834 | A | | 7/2012 |
| JP | 2017-174221 | A | | 9/2017 |
| JP | 2018-100369 | A | | 6/2018 |
| JP | 2020-66645 | A | | 4/2020 |
| WO | WO 93/24597 | A1 | | 12/1993 |
| WO | WO 2010/085545 | A1 | | 7/2010 |
| WO | WO 2019/087351 | A1 | | 5/2019 |
| WO | WO 2020/166354 | A1 | | 8/2020 |

OTHER PUBLICATIONS

English-language machine translation of CN110746294A (Year: 2020).*

International Preliminary Report on Patentability and English translation of the Written Opinion of the International Searching Authority for International Application No. PCT/JP2021/041322, dated May 25, 2023.

English Translation of CN Search Report issued in Application No. 202180035777.X, dated Feb. 22, 2023.

International Search Report for PCT/JP2021/041322 (PCT/ISA/210) mailed on Jan. 18, 2022.

Extended European Search Report for European Application No. 21891897.7, dated Mar. 18, 2024.

* cited by examiner

*Primary Examiner* — James C Goloboy

(74) *Attorney, Agent, or Firm* — Birch, Stewart, Kolasch & Birch, LLP

(57) ABSTRACT

A lubricant base oil of the present invention includes an ester compound including: a structural moiety (A) that is derived from an alcohol compound (A); and a structural moiety (B) that is derived from a carboxylic acid, the structural moiety B including: a structural moiety (B1) that is derived from a monocarboxylic acid (B1); and a structural moiety (B2) that is derived from an aliphatic monocarboxylic acid (B2) having 4 or more and 18 or less carbon atoms. According to the present invention, it is possible to provide a lubricant base oil having excellent low-temperature stability and high heat resistance while maintaining torque-lowering properties.

18 Claims, No Drawings

LUBRICANT BASE OIL

TECHNICAL FIELD

The present invention relates to a lubricant base oil, a lubricant oil, and a method for producing a lubricant base oil.

BACKGROUND ART

Lubricant oils are required to have torque-lowering properties, low-temperature stability, and high heat resistance.

JP-A-2018-100369 describes a lubricant base oil that contains an ester compound of pentaerythritol, the ester compound including in the structure thereof a benzoyloxy group or a naphthoyloxy group, and that thereby has high heat resistance and is less likely to be thermally degraded even at high temperatures.

JP-A-2017-174221 describes a lubricant oil composition that is obtained by adding a combination of a specific phenolic antioxidant and an aminic antioxidant to an ester synthetic oil having a specific viscosity and that can thereby reduce volatilization under high temperature conditions.

SUMMARY OF THE INVENTION

The present invention is a lubricant base oil including an ester compound including: a structural moiety (A) that is derived from an alcohol compound (A) represented by a general formula (1) below; and a structural moiety (B) that is derived from a carboxylic acid, the structural moiety B including: a structural moiety (B1) that is derived from a monocarboxylic acid (B1) represented by a general formula (2) below; and a structural moiety (B2) that is derived from an aliphatic monocarboxylic acid (B2) having 4 or more and 18 or less carbon atoms,

[Formula 1]

(1)

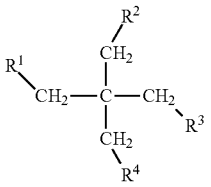

wherein $R^1$ is a hydroxy group, and $R^2$ to $R^4$ are independently a hydroxy group, a hydrogen atom, or a saturated hydrocarbon group having 1 or more and 3 or less carbon atoms,

[Formula 2]

(2)

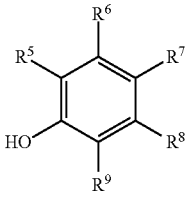

wherein any one of $R^5$ to $R^9$ is a carboxyl group, —$CH_2$—COOH, or —$CH_2$—$CH_2$—COOH, and others are each independently a hydrogen atom, a hydroxy group, or a saturated hydrocarbon group having 1 or more and 10 or less carbon atoms.

DETAILED DESCRIPTION OF THE INVENTION

It has been difficult for conventional lubricant base oil and the like to achieve both low-temperature stability and high heat resistance.

The present invention provides a lubricant base oil having excellent low-temperature stability and high heat resistance while maintaining torque-lowering properties.

The present invention is a lubricant base oil including an ester compound including: a structural moiety (A) that is derived from an alcohol compound (A) represented by a general formula (1) below; and a structural moiety (B) that is derived from a carboxylic acid, the structural moiety B including: a structural moiety (B1) that is derived from a monocarboxylic acid (B1) represented by a general formula (2) below; and a structural moiety (B2) that is derived from an aliphatic monocarboxylic acid (B2) having 4 or more and 18 or less carbon atoms,

[Formula 3]

(1)

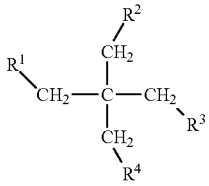

wherein $R^1$ is a hydroxy group, and $R^2$ to $R^4$ are independently a hydroxy group, a hydrogen atom, or a saturated hydrocarbon group having 1 or more and 3 or less carbon atoms,

[Formula 4]

(2)

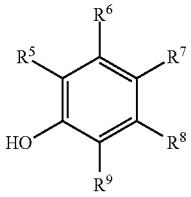

wherein any one of $R^5$ to $R^9$ is a carboxyl group, —$CH_2$—COOH, or —$CH_2$—$CH_2$—COOH, and others are each independently a hydrogen atom, a hydroxy group, or a saturated hydrocarbon group having 1 or more and 10 or less carbon atoms.

According to the present invention, it is possible to provide a lubricant base oil having excellent low-temperature stability and high heat resistance while maintaining torque-lowering properties.

One embodiment according to the present invention is explained below.

<Lubricant Base Oil>

A lubricant base oil of the present embodiment includes an ester compound including: a structural moiety (A) that is derived from an alcohol compound (A) represented by a general formula (1) below; and a structural moiety (B) that is derived from a carboxylic acid, the structural moiety B including: a structural moiety (B1) that is derived from a monocarboxylic acid (B1) represented by a general formula (2) below; and a structural moiety (B2) that is derived from an aliphatic monocarboxylic acid (B2) having 4 or more and 18 or less carbon atoms,

[Formula 5]

(1)

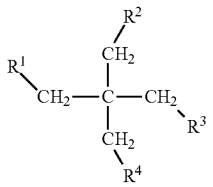

wherein $R^1$ is a hydroxy group, and $R^2$ to $R^4$ are independently a hydroxy group, a hydrogen atom, or a saturated hydrocarbon group having 1 or more and 3 or less carbon atoms,

[Formula 6]

(2)

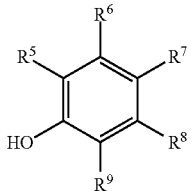

wherein any one of $R^5$ to $R^9$ is a carboxyl group, —$CH_2$—COOH, or —$CH_2$—$CH_2$—COOH, and others are each independently a hydrogen atom, a hydroxy group, or a saturated hydrocarbon group having 1 or more and 10 or less carbon atoms.

The lubricant base oil according to the present embodiment has excellent low-temperature stability and high heat resistance while maintaining torque-lowering properties. The reason why the lubricant base oil exhibits such an effect is not clear, but the lubricant base oil is considered to have achieved low-temperature stability and high heat resistance while maintaining torque-lowering properties, because the lubricant base oil includes, in the ester molecular backbone, the structure described above, and thereby lowers crystallizability and suppresses thermal decomposition.

[Ester Compound]

[Structural Moiety (A)]

The structural moiety (A) is a structural moiety derived from the alcohol compound (A) represented by the general formula (1).

In the general formula (1), $R^1$ is a hydroxy group, and $R^2$ to $R^4$ are independently a hydroxy group, a hydrogen atom, or a saturated hydrocarbon group having 1 or more and 3 or less carbon atoms. Preferably at least one of $R^2$ to $R^4$ is a hydroxy group, more preferably at least two are hydroxy groups, further preferably all are hydroxy groups, from the viewpoint of achieving both torque-lowering properties and high heat resistance.

Examples of the alcohol compound (A) include pentaerythritol, trimethylolpropane, trimethylolethane, and neopentyl glycol. The alcohol compound (A) is preferably one or more selected from pentaerythritol, trimethylolpropane, or neopentyl glycol, more preferably one or more selected from pentaerythritol or trimethylolpropane, further preferably pentaerythritol, from the viewpoint of achieving both torque-lowering properties and high heat resistance.

[Structural Moiety (B)]

The structural moiety (B) is a structural moiety derived from a carboxylic acid. The structural moiety (B) includes the structural moiety (B1) and the structural moiety (B2).

(Structural Moiety (B1))

The structural moiety (B1) is a structural moiety derived from the monocarboxylic acid (B1) represented by the general formula (2). In the general formula (2), any one of $R^5$ to $R^9$ is a carboxyl group, —$CH_2$—COOH, or —$CH_2$—$CH_2$—COOH, and the others are each independently a hydrogen atom, a hydroxy group, or a saturated hydrocarbon group having 1 or more and 10 or less carbon atoms. Any one of $R^5$ to $R^9$ is preferably a carboxyl group or —$CH_2$—COOH, more preferably a carboxyl group, from the viewpoint of reducing torque. $R^5$ to $R^9$ other than corresponding to a carboxyl group, —$CH_2$—COOH, or —$CH_2$—$CH_2$—COOH are each independently preferably a hydroxy group or a saturated hydrocarbon group having 1 or more and 10 or less carbon atoms, more preferably a saturated hydrocarbon group having 1 or more and 10 or less carbon atoms, from the viewpoint of achieving both torque-lowering properties and high heat resistance. The saturated hydrocarbon group has preferably 2 or more carbon atoms, more preferably 4 or more carbon atoms from the viewpoint of achieving both torque-lowering properties and high heat resistance, and has preferably 6 or less carbon atoms, more preferably 4 or less carbon atoms from the viewpoint of achieving both torque-lowering properties and high heat resistance.

In the general formula (2), it is preferred that $R^7$ is a carboxyl group, —$CH_2$—COOH, or —$CH_2$—$CH_2$—COOH and the others are each independently a hydrogen atom, a hydroxy group, or a saturated hydrocarbon group having 1 or more and 10 or less carbon atoms. $R^7$ is preferably a carboxyl group or —$CH_2$—COOH, more preferably a carboxyl group. $R^5$, $R^6$, $R^8$, and $R^9$ are each independently preferably a hydroxy group or a saturated hydrocarbon group having 1 or more and 10 or less carbon atoms, more preferably a saturated hydrocarbon group having 1 or more and 10 or less carbon atoms, from the viewpoint of achieving both torque-lowering properties and high heat resistance. The saturated hydrocarbon group has preferably 2 or more carbon atoms, more preferably 4 or more carbon atoms from the viewpoint of achieving both torque-lowering properties and high heat resistance, and has preferably 6 or less carbon atoms, more preferably 4 or less carbon atoms from the viewpoint of achieving both torque-lowering properties and high heat resistance.

Examples of the monocarboxylic acid (B1) include: hydroxybenzoic acids such as 3-hydroxybenzoic acid, 5-methyl-3-hydroxybenzoic acid, 5-ethyl-3-hydroxybenzoic acid, 4-ethyl-3-hydroxybenzoic acid, 5-isopropyl-3-hydroxybenzoic acid, 6-isopropyl-3-hydroxybenzoic acid, 5-n-butyl-3-hydroxybenzoic acid, 5-tert-butyl-3-hydroxybenzoic acid, 5-sec-butyl-3-hydroxybenzoic acid, 5-isoheptyl-3-hydroxybenzoic acid, 5-isohexyl-3-hydroxybenzoic acid, 5-isooctyl-3-hydroxybenzoic acid, 4-methoxy-3-hydroxybenzoic acid, 4-ethoxy-3-hydroxybenzoic acid, 6-butoxy-3-hydroxybenzoic acid, 4-hydroxybenzoic acid, 6-methyl-4-hydroxybenzoic acid, 6-ethyl-4-hydroxybenzoic acid, 6-isopropyl-4-hydroxybenzoic acid, 6-tert-butyl-4-hydroxybenzoic acid, 6-sec-butyl-4-hydroxybenzoic acid, 6-isohexyl-4-hydroxybenzoic acid, 6-isoheptyl-4-hydroxybenzoic acid, 6-isooctyl-4-hydroxybenzoic acid, 5-n-propyl-4-hydroxybenzoic acid, 5-methoxy-4-hydroxybenzoic acid, 6-butoxy-4-hydroxybenzoic acid, 5-ethoxy-4-hydroxybenzoic acid, 3-tert-butyl-4-hydroxybenzoic acid, 3-isooctyl-4-hydroxybenzoic acid, 3,5-dimethyl-4-hydroxybenzoic acid, 3,5-di-tert-butyl-4-hydroxybenzoic acid, 5,6-di-tert-butyl-4-hydroxybenzoic acid, 2-hydroxybenzoic acid, 3-methyl-2-hydroxybenzoic acid, 3-isopropyl-2-hydroxybenzoic acid, 3-tert-butyl-2-hydroxybenzoic acid, 6-methoxy-2-hydroxybenzoic acid, and 6-ethoxy-2-hydroxybenzoic acid; dihydroxy aromatic carboxylic acids such as 2,3-dihydroxybenzoic acid, 2,4-dihydroxybenzoic acid, 2,5-dihydroxybenzoic acid, 2,6-dihydroxybenzoic acid, 3,4-dihydroxybenzoic acid, 3,5-dihydroxybenzoic acid, 2,6-dihydroxy-4-methylbenzoic acid, 2,4-dihydroxy-6-methylbenzoic acid, 3,5-dihydroxy-4-methylbenzoic acid, 2,3-dihydroxy-4-methoxybenzoic acid, 3,4-dihydroxy-5-methoxybenzoic acid, 2,4-di(hydroxymethyl)benzoic acid, and 3,4-di(hydroxymethyl)benzoic acid; trihydroxybenzoic acids such as 3,4,5-trihydroxybenzoic acid and 2,4,6-trihydroxybenzoic acid; and 2-hydroxyphenylacetic acid, 3-hydroxyphenylacetic acid, 4-hydroxyphenylacetic acid, 3-(2-hydroxyphenyl)propionic acid, 3-(3-hydroxyphenyl)propionic acid, 3-(4-hydroxyphenyl)propionic acid, 2-(2-hydroxyphenyl)propionic acid, 2-(3-hydroxyphenyl)propionic acid, and 2-(4-hydroxyphenyl)propionic acid. Among these examples, the monocarboxylic acid (B1) is preferably one or two or more selected from the group consisting of 4-hydroxybenzoic acid, 3,5-di-tert-butyl-4-hydroxybenzoic acid, 3,4-dihydroxybenzoic acid, and 3,4,5-trihydroxybenzoic acid, more preferably one or two or more selected from the group consisting of 3,5-di-tert-butyl-4-hydroxybenzoic acid and 3,4-dihydroxybenzoic acid, from the viewpoint of achieving both torque-lowering properties and high heat resistance.

The proportion of the structural moiety (B1) in the structural moiety (B) of the ester compound is preferably 0.1 mol % or more, more preferably 1 mol % or more from the viewpoint of achieving both torque-lowering properties and high heat resistance, and is preferably 5 mol % or less, more preferably 3 mol % or less from the viewpoint of achieving both torque-lowering properties and high heat resistance.

(Structural Moiety (B2))

The structural moiety (B2) is a structural moiety derived from the aliphatic monocarboxylic acid (B2) having 4 or more and 18 or less carbon atoms. The structural moiety (B2) has 4 or more carbon atoms, preferably 7 or more carbon atoms from the viewpoint of achieving both torque-lowering properties and high heat resistance, and has 18 or less carbon atoms, preferably 9 or less carbon atoms from the viewpoint of achieving both torque-lowering properties and high heat resistance.

Examples of the aliphatic monocarboxylic acid (B2) include: linear fatty acids such as butanoic acid, pentanoic acid, hexanoic acid, heptanoic acid, octanoic acid, nonanoic acid, decanoic acid, dodecanoic acid, tetradecanoic acid, pentadecanoic acid, hexadecanoic acid, heptadecanoic acid, and octadecanoic acid; and branched fatty acids such as 2-methylpropanoic acid, 2-methylbutanoic acid, 3-methylbutanoic acid, 2,2-dimethylpropanoic acid, 2-methylpentanoic acid, 3-methylpentanoic acid, 4-methylpentanoic acid, 2,2-dimethylbutanoic acid, 2,3-dimethylbutanoic acid, 3,3-dimethylbutanoic acid, 2-methylhexanoic acid, 3-methylhexanoic acid, 4-methylhexanoic acid, 5-methylhexanoic acid, 2,2-dimethylpentanoic acid, 2,3-dimethylpentanoic acid, 2,4-dimethylpentanoic acid, 3,3-dimethylpentanoic acid, 3,4-dimethylpentanoic acid, 4,4-dimethylpentanoic acid, 2-ethylpentanoic acid, 3-ethylpentanoic acid, 2,2,3-trimethylbutanoic acid, 2,3,3-trimethylbutanoic acid, 2-ethyl-2-methylbutanoic acid, 2-ethyl-3-methylbutanoic acid, 2-methylheptanoic acid, 3-methylheptanoic acid, 4-methylheptanoic acid, 5-methylheptanoic acid, 6-methylheptanoic acid, 2-ethylhexanoic acid, 3-ethylhexanoic acid, 4-ethylhexanoic acid, 2,2-dimethylhexanoic acid, 2,3-dimethylhexanoic acid, 2,4-dimethylhexanoic acid, 2,5-dimethylhexanoic acid, 3,3-dimethylhexanoic acid, 3,4-dimethylhexanoic acid, 3,5-dimethylhexanoic acid, 4,4-dimethylhexanoic acid, 4,5-dimethylhexanoic acid, 5,5-dimethylhexanoic acid, 2-propylpentanoic acid, 2-methyloctanoic acid, 3-methyloctanoic acid, 4-methyloctanoic acid, 5-methyloctanoic acid, 6-methyloctanoic acid, 7-methyloctanoic acid, 2,2-dimethylheptanoic acid, 2,3-dimethylheptanoic acid, 2,4-dimethylheptanoic acid, 2,5-dimethylheptanoic acid, 2,6-dimethylheptanoic acid, 3,3-dimethylheptanoic acid, 3,4-dimethylheptanoic acid, 3,5-dimethylheptanoic acid, 3,6-dimethylheptanoic acid, 4,4-dimethylheptanoic acid, 4,5-dimethylheptanoic acid, 4,6-dimethylheptanoic acid, 5,5-dimethylheptanoic acid, 5,6-dimethylheptanoic acid, 6,6-dimethylheptanoic acid, 2-methyl-2-ethylhexanoic acid, 2-methyl-3-ethylhexanoic acid, 2-methyl-4-ethylhexanoic acid, 3-methyl-2-ethylhexanoic acid, 3-methyl-3-ethylhexanoic acid, 3-methyl-4-ethylhexanoic acid, 4-methyl-2-ethylhexanoic acid, 4-methyl-3-ethylhexanoic acid, 4-methyl-4-ethylhexanoic acid, 5-methyl-2-ethylhexanoic acid, 5-methyl-3-ethylhexanoic acid, 5-methyl-4-ethylhexanoic acid, 2-ethylheptanoic acid, 3-methyloctanoic acid, 3,5,5-trimethylhexanoic acid, 2-ethyl-2,3,3-trimethylbutyric acid, 2,2,4,4-tetramethylpentanoic acid, 2,2,3,3-tetramethylpentanoic acid, and 2,2,3,4-tetramethylpentanoic acid. Among these examples, the aliphatic monocarboxylic acid (B2) is preferably one or two or more selected from the group consisting of heptanoic acid and nonanoic acid, from the viewpoint of achieving both torque-lowering properties and high heat resistance.

The proportion of the structural moiety (B2) in the structural moiety (B) of the ester compound is preferably 80 mol % or more, more preferably 90 mol % or more, further preferably 95 mol % or more, still further preferably 97 mol % or more from the viewpoint of achieving both torque-lowering properties and high heat resistance, and is preferably 99.9 mol % or less, more preferably 99 mol % or less from the viewpoint of achieving both torque-lowering properties and high heat resistance.

The ratio (the amount of substance (mol) of the structural moiety (B1)/the amount of substance (mol) of the structural moiety (B2)) of the amount of substance (mol) of the structural moiety (B1) to the amount of substance (mol) of the structural moiety (B2) in the structural moiety (B) is preferably 0.001 or more, more preferably 0.01 or more from the viewpoint of achieving both torque-lowering properties and high heat resistance, and is preferably 0.05 or less, more preferably 0.03 or less from the viewpoint of achieving both torque-lowering properties and high heat resistance.

The structural moiety (B) may include a structural moiety other than the structural moieties (B1) and (B2) as long as the effects of the present invention are not impaired. The proportion of the structural moiety other than the structural moieties (B1) and (B2) in the structural moiety (B) of the ester compound is preferably 10 mol % or less, more preferably 5 mol % or less, further preferably 1 mol % or less.

The ester compound preferably includes an ester compound (A) and an ester compound (B) below from the viewpoint of achieving all torque-lowering properties, low-temperature stability, and high heat resistance.

Ester compound (A): a compound obtained by bonding an alcohol compound (A1) represented by the general formula (1), in which $R^1$ to $R^4$ are all hydroxy groups, to the aliphatic monocarboxylic acids (B2) at all the hydroxy groups through ester bonds Ester compound (B): a compound obtained by bonding the alcohol compound (A1) to the monocarboxylic acid (B1) at one of the hydroxy groups through an ester bond and to the aliphatic monocarboxylic acids (B2) at the other three hydroxy groups through ester bonds The content of the ester compound (A) in the ester compound is preferably 25 mass % or more, more preferably 40 mass % or more, further preferably 45 mass % or more, still further preferably 50 mass % or more, still further preferably 60 mass % or more, still further preferably 80 mass % or more, from the viewpoint of torque-lowering properties. The content of the ester compound (A) in the ester compound is preferably 99 mass % or less, more preferably 98 mass % or less, further preferably 95 mass % or less, still further preferably 92 mass % or less, still further preferably 90 mass % or less, from the viewpoint of high heat resistance.

The content of the ester compound (B) in the ester compound is preferably 1 mass % or more, more preferably 2 mass % or more, further preferably 5 mass % or more, still further preferably 8 mass % or more, still further preferably 10 mass % or more, from the viewpoint of high heat resistance. The content of the ester compound (B) in the ester compound is preferably 75 mass % or less, more preferably 60 mass % or less, further preferably 55 mass % or less, still further preferably 50 mass % or less, still further preferably 40 mass % or less, still further preferably 20 mass % or less, from the viewpoint of torque-lowering properties.

The total content of the ester compounds (A) and (B) in the ester compound is preferably 80 mass % or more, more preferably 90 mass % or more, further preferably 95 mass % or more, still further preferably substantially 100 mass %, still further preferably 100 mass %, from the viewpoint of achieving all torque-lowering properties, low-temperature stability, and high heat resistance. The meaning of substantially 100 mass % in the present description includes the case in which a substance other than the ester compounds (A) and (B) is inevitably mixed in.

The mass ratio (the mass of the ester compound (A) in the ester compound/the ester compound (B) in the ester compound) of the ester compound (A) to the ester compound (B) in the ester compound is preferably 1 or more, more preferably 1.5 or more, further preferably 2 or more from the viewpoint of torque-lowering properties, and is preferably 70 or less, more preferably 60 or less, further preferably 50 or less from the viewpoint of high heat resistance.

The content of the ester compound in the lubricant base oil is preferably 90 mass % or more, more preferably 95 mass % or more, further preferably substantially 100 mass %, still further preferably 100 mass %, from the viewpoint of achieving both torque-lowering properties and high heat resistance.

<Method for Producing Lubricant Base Oil>

A method, according to the present embodiment, for producing a lubricant base oil is a method for producing the above-mentioned lubricant base oil, the method including a reaction step of performing an esterification reaction and/or a transesterification reaction of the alcohol compound (A) with a carboxylic acid component for deriving the structural moiety (B). The carboxylic acid component for deriving the structural moiety (B) contains the monocarboxylic acid (B1) and/or an ester-forming derivative of the monocarboxylic acid (B1), and the aliphatic monocarboxylic acid (B2) and/or an ester-forming derivative of the aliphatic monocarboxylic acid (B2).

Examples of the ester-forming derivative of the monocarboxylic acid (B1) include a C1-6 alkyl ester. Examples of the ester-forming derivative of the aliphatic monocarboxylic acid (B2) include a C1-6 alkyl ester of the aliphatic monocarboxylic acid (B2).

The esterification reaction and the transesterification reaction in the reaction step can be performed by a known method.

<Lubricant Oil Composition>

A lubricant oil composition according to the present embodiment contains the lubricant base oil. The lubricant oil composition may contain other additives as long as the effects of the present invention are not impaired. Examples of the other additives include a cleanser, a dispersant, an antioxidant, an oiliness improver, a wear inhibitor, an extreme pressure agent, a rust inhibitor, a corrosion inhibitor, a metal deactivator, a viscosity index improver, a pour-point depressant, a defoamer, an emulsifier, a demulsifier, an antifungal agent, and a solid lubricant.

The content of the lubricant base oil in the lubricant oil composition is preferably 50 mass % or more, more preferably 80 mass % or more, further preferably 90 mass % or more, still further preferably 95 mass % or more.

The total content of the other additives in the lubricant oil composition is preferably 10 parts by mass or less, more preferably 8 parts by mass or less, further preferably 5 parts by mass or less.

The content of the ester compound (A) in the lubricant oil composition is preferably 12.5 mass % or more, more preferably 25 mass % or more, further preferably 40 mass % or more, still further preferably 60 mass % or more, from the viewpoint of torque-lowering properties. The content of the ester compound (A) in the lubricant oil composition is preferably 99 mass % or less, more preferably 98 mass % or less, further preferably 95 mass % or less, still further preferably 92 mass % or less, still further preferably 90 mass % or less, from the viewpoint of high heat resistance.

The content of the ester compound (B) in the lubricant oil composition is preferably 0.5 mass % or more, more preferably 2 mass % or more, further preferably 5 mass % or more, still further preferably 8 mass % or more, still further preferably 10 mass % or more, from the viewpoint of high heat resistance. The content of the ester compound (B) in the lubricant oil composition is preferably 75 mass % or less, more preferably 60 mass % or less, further preferably 55 mass % or less, still further preferably 50 mass % or less, still further preferably 40 mass % or less, still further preferably 20% or less, from the viewpoint of torque-lowering properties.

The lubricant oil composition is usable for combustion lubricant oils such as a gasoline engine oil, a diesel engine oil, and a marine engine oil; and non-combustion lubricant oils such as a gear oil, an automatic transmission oil, a hydraulic oil, a fire-resistant hydraulic fluid, a refrigerant oil, a compressor oil, a vacuum pump oil, a bearing oil, an insulating oil, a turbine oil, a sliding surface oil, a rock drill oil, a metal working oil, a plastic working oil, a heat treatment oil, and grease. Particularly, the lubricant oil composition is preferably used for the non-combustion lubricant oils. The lubricant oil composition is also usable for sliding parts such as a sliding bearing (rotational sliding), a thrust bearing (planar sliding), and a spline (sliding), and is usable for a method for lubricating a spline section of a clutch disc, a shaft and a gear-inside-diameter bearing section of a transmission, a spline section of a hub-sleeve, metal-supported parts in sections, and a spline section of a change operating system.

With respect to the above-mentioned embodiments, the present description further discloses below a lubricant base oil, a lubricant oil composition, and a method for producing a lubricant base oil.

<1> A lubricant base oil including an ester compound including: a structural moiety (A) that is derived from an alcohol compound (A) represented by a general formula (1) below; and a structural moiety (B) that is derived from a carboxylic acid, the structural moiety B including: a structural moiety (B1) that is derived from a monocarboxylic acid (B1) represented by a general formula (2) below; and a structural moiety (B2) that is derived from an aliphatic monocarboxylic acid (B2) having 4 or more and 18 or less carbon atoms,

[Formula 7]

(1)

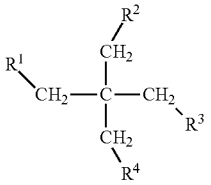

wherein $R^1$ is a hydroxy group, and $R^2$ to $R^4$ are independently a hydroxy group, a hydrogen atom, or a saturated hydrocarbon group having 1 or more and 3 or less carbon atoms,

[Formula 8]

(2)

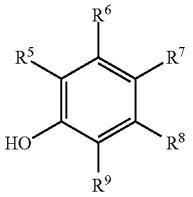

wherein any one of $R^5$ to $R^9$ is a carboxyl group, —$CH_2$—COOH, or —$CH_2$—$CH_2$—COOH, and others are each independently a hydrogen atom, a hydroxy group, or a saturated hydrocarbon group having 1 or more and 10 or less carbon atoms.

<2> The lubricant base oil according to <1>, wherein a proportion of the structural moiety (B1) in the structural moiety (B) is 0.1 mol % or more and 5 mol % or less.

<3> The lubricant base oil according to <1> or <2>, wherein a ratio (an amount of substance (mol) of the structural moiety (B1)/an amount of substance (mol) of the structural moiety (B2)) of an amount of substance (mol) of the structural moiety (B1) to an amount of substance (mol) of the structural moiety (B2) in the structural moiety (B) is 0.001 or more and 0.05 or less.

<4> The lubricant base oil according to any one of <1> to <3>, wherein $R^7$ in the general formula (2) is a carboxyl group.

<5> The lubricant base oil according to any one of <1> to <4>, wherein the alcohol compound (A) is one or more selected from the group consisting of pentaerythritol and trimethylolpropane.

<6> The lubricant base oil according to any one of <1> to <5>, wherein the proportion of the structural moiety (B1) in the structural moiety (B) is 0.1 mol % or more and 5 mol %, wherein $R^7$ in the general formula (2) is the carboxyl group, wherein the alcohol compound (A) is pentaerythritol.

<7> The lubricant base oil according to any one of <1> to <6>, wherein the proportion of the structural moiety (B1) in the structural moiety (B) is 1 mol % or more and 3 mol %, wherein $R^7$ in the general formula (2) is the carboxyl group, wherein the alcohol compound (A) is pentaerythritol.

<8> The lubricant base oil according to any one of <1> to <7>, wherein the ratio of the amount of substance (mol) of the structural moiety (B1) to the amount of substance (mol) of the structural moiety (B2) in the structural moiety (B) is 0.001 or more and 0.05 or less, wherein $R^7$ in the general formula (2) is the carboxyl group, wherein the alcohol compound (A) is pentaerythritol.

<9> The lubricant base oil according to any one of <1> to <8>, wherein the ratio of the amount of substance (mol) of the structural moiety (B1) to the amount of substance (mol) of the structural moiety (B2) in the structural moiety (B) is 0.01 or more and 0.03 or less, wherein $R^7$ in the general formula (2) is the carboxyl group, wherein the alcohol compound (A) is pentaerythritol.

<10> The lubricant base oil according to any one of <1> to <9>, wherein the proportion of the structural moiety (B1) in the structural moiety (B) is 1 mol % or more and 3 mol %, wherein the ratio of the amount of substance (mol) of the structural moiety (B1) to the amount of substance (mol) of the structural moiety (B2) in the structural moiety (B) is 0.01 or more and 0.03 or less, wherein $R^7$ in the general formula (2) is the carboxyl group, wherein the alcohol compound (A) is pentaerythritol.

<11> The lubricant base oil according to any one of <1> to <10>, wherein the ester compound includes an ester compound (A) and an ester compound (B) below:

ester compound (A): a compound obtained by bonding an alcohol compound (A1) represented by the general formula (1), in which $R^1$ to $R^4$ are all hydroxy groups, to the aliphatic monocarboxylic acids (B2) at all the hydroxy groups through ester bonds;

ester compound (B): a compound obtained by bonding the alcohol compound (A1) to the monocarboxylic acid (B1) at one of the hydroxy groups through an ester bond and to the aliphatic monocarboxylic acids (B2) at other three hydroxy groups through ester bonds.

<12> The lubricant base oil according to any one of <1> to <11>, wherein a content of the ester compound (A) in the ester compound is 25 mass % or more and 99 mass % or less.

<13> The lubricant base oil according to any one of <1> to <14>, wherein a content of the ester compound (B) in the ester compound is 1 mass % or more and 75 mass % or less.

<14> The lubricant base oil according to any one of <1> to <13>, wherein the content of the ester compound (A) in the ester compound is 80 mass % or more and 99 mass % or less, wherein the content of the ester compound (B) in the ester compound is 1 mass % or more and 20 mass % or less.

<15> The lubricant base oil according to any one of <1> to <14>, wherein the content of the ester compound (A) in the ester compound is 80 mass % or more and 90 mass % or less, wherein the content of the ester compound (B) in the ester compound is 1 mass % or more and 10 mass % or less.

<16> The lubricant base oil according to any one of <1> to <15>, wherein a total content of the ester compounds (A) and (B) in the ester compound is 80 mass % or more.

<17> The lubricant base oil according to any one of <1> to <16>, wherein a mass ratio (a mass of the ester compound (A) in the ester compound/the ester compound (B) in the ester compound) of the ester compound (A) to the ester compound (B) in the ester compound is 1 or more and 70 or less.

<18> The lubricant base oil according to any one of <1> to <17>, wherein the content of the ester compound (A) in the ester compound is 80 mass % or more and 99 mass % or less, wherein the content of the ester compound (B) in the ester compound is 1 mass % or more and 20 mass % or less, wherein the mass ratio of the ester compound (A) to the ester compound (B) in the ester compound is 1.5 or more and 60 or less.

<19> The lubricant base oil according to < >, wherein the content of the ester compound (A) in the ester compound is 80 mass % or more and 90 mass % or less, wherein the content of the ester compound (B) in the ester compound is 10 mass % or more and 20 mass % or less, wherein the mass ratio of the ester compound (A) to the ester compound (B) in the ester compound is 2 or more and 50 or less.

<20> A lubricant oil composition including the lubricant base oil according to any one of <1> to <19>.

<21> The lubricant oil composition according to <20>, wherein a content of the lubricant base oil in the lubricant oil composition is 50 mass % or more.

<22> The lubricant oil composition according to <20> or <21>, wherein a content of the ester compound (A) in the lubricant oil composition is 12.5 mass % or more and 99 mass % or less.

<23> The lubricant base oil according to any one of <20> to <22>, wherein a content of the ester compound (B) in the lubricant oil composition is 0.5 mass % or more and 75 mass % or less.

<24> The lubricant base oil according to any one of <20> to <23>, wherein the content of the ester compound (A) in the lubricant oil composition is 40 mass % or more and 98 mass % or less, wherein the content of the ester compound (B) in the lubricant oil composition is 2 mass % or more and 60 mass % or less.

<25> The lubricant base oil according to any one of <20> to <24>, wherein the content of the ester compound (A) in the lubricant oil composition is 60 mass % or more and 95 mass % or less, wherein the content of the ester compound (B) in the lubricant oil composition is 5 mass % or more and 40 mass % or less.

<26> A method for using an ester compound as a lubricant base oil, the ester compound containing an ester compound that includes: a structural moiety (A) that is derived from an alcohol compound (A) represented by a general formula (1) below; and a structural moiety (B) that is derived from a carboxylic acid, the structural moiety B including: a structural moiety (B1) that is derived from a monocarboxylic acid (B1) represented by a general formula (2) below; and a structural moiety (B2) that is derived from an aliphatic monocarboxylic acid (B2) having 4 or more and 18 or less carbon atoms,

[Formula 9]

(1)

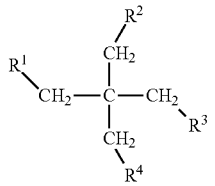

wherein $R^1$ is a hydroxy group, and $R^2$ to $R^4$ are independently a hydroxy group, a hydrogen atom, or a saturated hydrocarbon group having 1 or more and 3 or less carbon atoms,

[Formula 10]

(2)

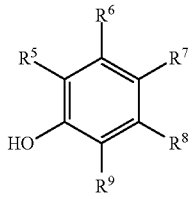

wherein any one of $R^5$ to $R^9$ is a carboxyl group, —$CH_2$—COOH, or —$CH_2$—$CH_2$—COOH, and others are each independently a hydrogen atom, a hydroxy group, or a saturated hydrocarbon group having 1 or more and 10 or less carbon atoms.

EXAMPLES

Hereinafter, the present invention will be described in more detail by way of working examples thereof.

However, the invention is not limited only to these working examples.

Preparation of Lubricant Base Oil

Example 1

As a monocarboxylic acid, 453.30 g of heptanoic acid and 11.0 g of 3,5-di-tert-butyl-4-hydroxybenzoic acid were added into a 1-L four-neck flask equipped with a stirrer, a thermometer, a nitrogen inlet tube, and a cooling tube, followed by addition of 150.1 g of pentaerythritol as an alcohol compound. The blending amount of the monocarboxylic acid was set so that the equivalent of all the carboxy groups in the monocarboxylic acid was 0.8 relative to 1 equivalent of the hydroxy groups of the alcohol compound. Next, a nitrogen gas was blown into the flask, and the mixture was heated to 250° C. under stirring. The temperature in the flask was kept at 250° C. for 4 hours and distillate water is removed from the flask using the cooling tube. After the completion of the reaction, 230.04 g of heptanoic acid was further added. The mixture was heated to 250° C. again. The temperature in the flask was kept at 250° C. for 10 hours and distillate water was removed from the flask using the cooling tube. After the completion of the reaction, an excessive carboxylic acid component was distilled away under a reduced pressure of 0.13 kPa, and the mixture was steamed under a reduced pressure of 0.13 kPa for 1 hour. A residual carboxylic acid component was adsorbed to an adsorbent (trade name: KYOWAAD 500SH, manufactured by Kyowa Chemical Industry Co., Ltd.) and the reaction product in the flask was then filtered to give a lubricant base oil 1 according to Example 1.

Examples 2, 3, 5, 6, and 8, and Comparative Examples 1 and 2

A lubricant base oil was obtained by the same method as in Example 1 except that the type of the raw materials and the blending amount thereof were changed as shown in Table 1.

Example 4

As a monocarboxylic acid, 305.10 g of heptanoic acid and 160.0 g of 3,5-di-tert-butyl-4-hydroxybenzoic acid were added into a 1-L four-neck flask equipped with a stirrer, a thermometer, a nitrogen inlet tube, and a cooling tube, followed by addition of 145.1 g of pentaerythritol as an alcohol compound, and 0.26 g of titanium tetraisopropoxide were added as a catalyst. The blending amount of the monocarboxylic acid was set so that the equivalent of all the carboxy groups in the monocarboxylic acid was 0.8 relative to 1 equivalent of the hydroxy groups of the alcohol compound. Next, a nitrogen gas was blown into the flask, and the mixture was heated to 250° C. under stirring. The temperature in the flask was kept at 250° C. for 4 hours and distillate water is removed from the flask using the cooling tube. After the completion of the reaction, 247.0 g of heptanoic acid was further added. The mixture was heated to 250° C. again. The temperature in the flask was kept at 250° C. for 10 hours and distillate water was removed from the flask using the cooling tube. After the completion of the reaction, 17.3 g of ion-exchanged water was added, the mixture was stirred at 80° C. for 1 hour to deactivate the catalyst, then water and an excessive carboxylic acid component were distilled away at a reduced pressure of 0.13 kPa, and the mixture was steamed at a reduced pressure of 0.13 kPa for 1 hour. A residual carboxylic acid component was adsorbed to an adsorbent (trade name: KYOWAAD 500SH, manufactured by Kyowa Chemical Industry Co., Ltd.) and the reaction product in the flask was then filtered to give a lubricant base oil 4 according to Example 4.

Example 7

A lubricant base oil according to Example 7 was obtained by the same method as in Example 4 except that the type of the raw materials and the blending amount thereof were changed as shown in Table 1.

Comparative Example 3

An ester compound according to Comparative Example 3 was obtained by the same method as in Example 1 except that the type of the raw materials and the blending amount thereof were changed as shown in Table 1. To the ester compound, an additive (IRGANOX1076 (manufactured by BASF SE)) was added so that the content of the additive in the lubricant base oil was 1.6 mass %, and a lubricant base oil according to Comparative Example 3 was thus obtained.

Table 1 shows the used amount of the raw materials for synthesis in the examples and the comparative examples. The raw materials shown in Tables 1 and 2 (shown later) are as follows.

- Trimethylolpropane (manufactured by Tokyo Chemical Industry Co., Ltd.)
- Pentaerythritol (manufactured by Tokyo Chemical Industry Co., Ltd.)
- Heptanoic acid (n-heptanoic acid, manufactured by Tokyo Chemical Industry Co., Ltd.)
- Nonanoic acid (manufactured by Tokyo Chemical Industry Co., Ltd.)
- 3,5-Di-tert-butyl-4-hydroxybenzoic acid (manufactured by Tokyo Chemical Industry Co., Ltd.)
- 4-Hydroxybenzoic acid (manufactured by FUJIFILM Wako Pure Chemical Corporation)
- 3,4-Dihdroxybenzoic acid (manufactured by FUJIFILM Wako Pure Chemical Corporation)
- Titanium tetraisopropoxide (manufactured by FUJIFILM Wako Pure Chemical Corporation)
- Methyl gallate (manufactured by Tokyo Chemical Industry Co., Ltd.)
- Benzoic acid (manufactured by FUJIFILM Wako Pure Chemical Corporation)
- IRGANOX1076 (manufactured by BASF SE)

TABLE 1

| | | | Unit | Example 1 | Example 2 | Example 3 | Example 4 | Example 5 | Example 6 |
|---|---|---|---|---|---|---|---|---|---|
| Prepared composition | Carboxylic acid and ester-forming derivative | Heptanoic acid | mol % | 99 | 92 | 75 | 85 | 95 | 95 |
| | | Nonanoic acid | mol % | | | | | | |
| | | 3,5-Di-tert-butyl-4-hydroxybenzoic acid | mol % | 1 | 8 | 25 | 15 | | |
| | | 4-Hydroxybenzoic acid | mol % | | | | | 5 | |
| | | 3,4-Dihydroxybenzoic acid | mol % | | | | | | 5 |
| | | Methyl gallate | mol % | | | | | | |
| | | Benzoic acid | mol % | | | | | | |
| | Alcohol | Pentaerythritol | mol % | 100 | 100 | 100 | 100 | 100 | 100 |
| | | Trimethylolpropane | mol % | | | | | | |

| | | | Unit | Example 7 | Example 8 | Comparative Example 1 | Comparative Example 2 | Comparative Example 3 |
|---|---|---|---|---|---|---|---|---|
| Prepared composition | Carboxylic acid and ester-forming derivative | Heptanoic acid | mol % | 95 | | 100 | 95 | 100 |
| | | Nonanoic acid | mol % | | 92 | | | |
| | | 3,5-Di-tert-butyl-4-hydroxybenzoic acid | mol % | | 8 | | | |
| | | 4-Hydroxybenzoic acid | mol % | | | | | |

TABLE 1-continued

| | | | | | | | |
|---|---|---|---|---|---|---|---|
| | 3,4-Dihydroxybenzoic acid | mol % | | | | | |
| | Methyl gallate | mol % | 5 | | | | |
| | Benzoic acid | mol % | | | | 5 | |
| Alcohol | Pentaerythritol | mol % | 100 | | 100 | 100 | 100 |
| | Trimethylolpropane | mol % | | 100 | | | |

<Evaluation>

[Composition of Ester Compound]

The composition of the ester compound contained in the lubricant base oil according to each of Examples 1 to 8 and Comparative Examples 1 to 3 was measured by the following method.

The ester compound was dissolved in deuterated acetone and measured by $^{1}$H-NMR using a nuclear magnetic resonator (trade name: Agilent 400-MR DD2 system, manufactured by Agilent Technologies, Inc.). The intensity of protons is proportional to the number of moles thereof. Therefore, from the proton-intensity ratio between peaks obtained in the measurement, the molar ratio in number between the ester groups having an alkyl chain and the ester groups having a phenol structure was calculated.

Alkyl chain: calculated on the basis of a peak that appeared around 2.3 ppm and was derived from a methylene group at the α-position of the alkyl chain Phenol structure: calculated on the basis of a peak that appeared around 8.0 ppm and was derived from methine hydrogen atoms at the 2-position and the 6-position of the aromatic ring Table 2 shows the composition of the ester compound obtained in the measurement, the ester compound being contained in the lubricant base oil according to each of Examples 1 to 8 and Comparative Examples 1 to 3.

TABLE 2

| | | | Unit | Example 1 | Example 2 | Example 3 | Example 4 | Example 5 | Example 6 |
|---|---|---|---|---|---|---|---|---|---|
| Composition of ester compound | Carboxylic acid component | Heptanoic acid | mol % | 99.5 | 97.8 | 95.2 | 92.2 | 95.8 | 96.8 |
| | | Nonanoic acid | mol % | | | | | | |
| | | 3,5-Di-tert-butyl-4-hydroxybenzoic acid | mol % | 0.5 | 2.2 | 4.8 | 7.8 | | |
| | | 4-Hydroxybenzoic acid | mol % | | | | | 4.2 | |
| | | 3,4-Dihydroxybenzoic acid | mol % | | | | | | 3.2 |
| | | Gallic acid | mol % | | | | | | |
| | | Benzoic acid | mol % | | | | | | |
| | Alcohol | Pentaerythritol | mol % | 100 | 100 | 100 | 100 | 100 | 100 |
| | | Trimethylolpropane | mol % | | | | | | |
| | Molar ratio (B1/B2) of structural moiety (B1) to structural moiety (B2) | | | 0.005 | 0.022 | 0.05 | 0.08 | 0.04 | 0.03 |
| | Content of ester compound (A) | | mass % | 98.0 | 91.2 | 80.8 | 68.8 | 83.2 | 87.2 |
| | Content of ester compound (B) | | mass % | 2.0 | 8.8 | 19.2 | 31.2 | 16.8 | 12.8 |
| | Content ratio (A/B) of ester compound (A) to ester compound (B) | | | 49.00 | 10.36 | 4.21 | 2.21 | 4.95 | 6.81 |

| | | | Unit | Example 7 | Example 8 | Comparative Example 1 | Comparative Example 2 | Comparative Example 3 |
|---|---|---|---|---|---|---|---|---|
| Composition of ester compound | Carboxylic acid component | Heptanoic acid | mol % | 95.8 | | 100 | 96.5 | 100 |
| | | Nonanoic acid | mol % | | 96.3 | | | |
| | | 3,5-Di-tert-butyl-4-hydroxybenzoic acid | mol % | | 3.7 | | | |
| | | 4-Hydroxybenzoic acid | mol % | | | | | |
| | | 3,4-Dihydroxybenzoic acid | mol % | | | | | |
| | | Gallic acid | mol % | 4.2 | | | | |
| | | Benzoic acid | mol % | | | | 3.5 | |
| | Alcohol | Pentaerythritol | mol % | 100 | | 100 | 100 | 100 |
| | | Trimethylolpropane | mol % | | 100 | | | |
| | Molar ratio (B1/B2) of structural moiety (B1) to structural moiety (B2) | | | 0.04 | 0.038 | — | — | — |
| | Content of ester compound (A) | | mass % | 83.2 | 88.9 | 100.0 | 86.0 | 100.0 |
| | Content of ester compound (B) | | mass % | 16.8 | 11.1 | 0.0 | 14.0 | 0.0 |
| | Content ratio (A/B) of ester compound (A) to ester compound (B) | | | 4.95 | 8.01 | — | 6.14 | — |

[Evaluation of Torque-Lowering Properties]

The kinematic viscosity of the lubricant base oil according to each of the examples and the comparative examples was evaluated by measuring 40° C. kinematic viscosity and 100° C. kinematic viscosity ($mm^2/s$) with a Stabinger kinematic viscometer (trade name: SVM3000, manufactured by Anton Paar GmbH) satisfying the accuracy required by ASTM D7042. The lower the viscosity is, the more excellent the torque-lowering properties are.

[Evaluation of High Heat Resistance]

The high heat resistance of the lubricant base oil according to each of the examples and the comparative examples was evaluated by measuring thermal response of the lubricant base oil using a simultaneous thermogravimetric analyzer (trade name: TG/DTA 6200 manufactured by Seiko Instruments Inc.), in an atmosphere of nitrogen and air at 200 mL/min, under the conditions of heating from 30° C. to 500° C. at 10° C./min and then retaining at 500° C. for 3 minutes, and comparing the lubricant base oils in terms of temperature at which the weight reduction rate (mass %) reaches 10%. The higher the temperature is, the more excellent the heat resistance is.

[Evaluation of Low-Temperature Stability (Pour Point)]

The pour point of the lubricant base oil according to each of the examples and the comparative examples was evaluated by measuring pour point (° C.) according to a measuring method in conformity with JIS K2269. The lower the pour point is, the more excellent the low-temperature stability is.

[Evaluation of Low-Temperature Stability (Appearance)]

The low-temperature stability of the lubricant base oil according to each of the examples and the comparative examples was evaluated by appearance thereof (liquid or solid) after a test in which a 10 mL sample was put into a screw tube (No. 5) and stored in low-temperature chamber PU-1KP (manufactured by ESPEC CORP.) at −20° C. for 1 day.

Table 3 shows the evaluation results.

TABLE 3

| | | Example 1 | Example 2 | Example 3 | Example 4 | Example 5 | Example 6 |
|---|---|---|---|---|---|---|---|
| Torque-lowering properties | 40° C. Kinematic viscosity ($mm^2/s$) | 22.7 | 28.3 | 44.5 | 59.3 | 31.8 | 32.3 |
| | 100° C. Kinematic viscosity ($mm^2/s$) | 4.8 | 5.4 | 6.9 | 8.0 | 5.9 | 5.9 |
| High heat resistance | 10% Vaporization temperature (TG) (° C.) | 302 | 313 | 319 | 313 | 300 | 316 |
| Low-temperature stability | Pour point (° C.) | −37.5 | −46.5 | −48 | −42 | <−50 | −48 |
| | Appearance after storage test (−20° C., 1 day) | Liquid | Liquid | Liquid | Liquid | Liquid | Liquid |

| | | Example 7 | Example 8 | Comparative Example 1 | Comparative Example 2 | Comparative Example 3 |
|---|---|---|---|---|---|---|
| Torque-lowering properties | 40° C. Kinematic viscosity ($mm^2/s$) | 48.1 | 28.7 | 21.3 | 23.5 | 21.8 |
| | 100° C. Kinematic viscosity ($mm^2/s$) | 7.5 | 5.4 | 4.6 | 4.8 | 4.7 |
| High heat resistance | 10% Vaporization temperature (TG) (° C.) | 317 | 318.0 | 286 | 291 | 303 |
| Low-temperature stability | Pour point (° C.) | <−50 | <−50 | −28 | −43 | −21 |
| | Appearance after storage test (−20° C., 1 day) | Liquid | Liquid | Liquid | Liquid | Solid |

From the results shown in Table 3, it is understood that the lubricant base oils according to Examples 1 to 8 have excellent torque-lowering properties, low-temperature stability, and high heat resistance.

The invention claimed is:

1. A lubricant base oil comprising an ester compound including: a structural moiety (A) that is derived from an alcohol compound (A) represented by a general formula (1) below; and a structural moiety (B) that is derived from a carboxylic acid, the structural moiety B including: a structural moiety (B1) that is derived from a monocarboxylic acid (B1) represented by a general formula (2) below; and a structural moiety (B2) that is derived from an aliphatic monocarboxylic acid (B2) having 4 or more and 18 or less carbon atoms,

[Formula 1]

(1)

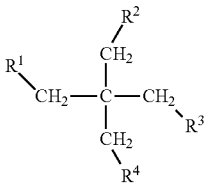

wherein $R^1$ is a hydroxy group, and $R^2$ to $R^4$ are independently a hydroxy group, a hydrogen atom, or a saturated hydrocarbon group having 1 or more and 3 or less carbon atoms,

[Formula 2]

(2)

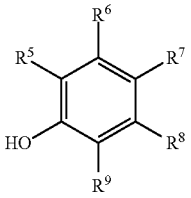

wherein any one of $R^5$ to $R^9$ is a carboxyl group, —$CH_2$—COOH, or —$CH_2$—$CH_2$—COOH, and others are each independently a hydrogen atom, a hydroxy group, or a saturated hydrocarbon group having 1 or more and 10 or less carbon atoms, and wherein a proportion of the structural moiety (B1) in the structural moiety (B) is 0.1 mol % or more and 5 mol % or less.

2. The lubricant base oil according to claim 1, wherein a ratio (an amount of substance (mol) of the structural moiety (B1)/an amount of substance (mol) of the structural moiety (B2)) of an amount of substance (mol) of the structural moiety (B1) to an amount of substance (mol) of the structural moiety (B2) in the structural moiety (B) is 0.001 or more and 0.05 or less.

3. The lubricant base oil according to claim 1, wherein $R^7$ in the general formula (2) is a carboxyl group.

4. The lubricant base oil according to claim 1, wherein the alcohol compound (A) is one or more selected from the group consisting of pentaerythritol and trimethylolpropane.

5. The lubricant base oil according to claim 1, wherein the ester compound includes an ester compound (A) and an ester compound (B) below:

ester compound (A): a compound obtained by bonding an alcohol compound (A1) represented by the general formula (1), in which $R^1$ to $R^4$ are all hydroxy groups, to the aliphatic monocarboxylic acids (B2) at all the hydroxy groups through ester bonds;

ester compound (B): a compound obtained by bonding the alcohol compound (A1) to the monocarboxylic acid (B1) at one of the hydroxy groups through an ester bond and to the aliphatic monocarboxylic acids (B2) at other three hydroxy groups through ester bonds.

6. The lubricant base oil according to claim 5, wherein a content of the ester compound (A) in the ester compound is 25 mass % or more and 99 mass % or less.

7. The lubricant base oil according to claim 5, wherein a content of the ester compound (B) in the ester compound is 1 mass % or more and 75 mass % or less.

8. The lubricant base oil according to claim 5, wherein a total content of the ester compounds (A) and (B) in the ester compound is 80 mass % or more.

9. The lubricant base oil according to claim 5, wherein a mass ratio (a mass of the ester compound (A) in the ester compound/the ester compound (B) in the ester compound) of the ester compound (A) to the ester compound (B) in the ester compound is 1 or more and 70 or less.

10. A lubricant oil composition comprising the lubricant base oil according to claim 1.

11. The lubricant oil composition according to claim 10, wherein a content of the lubricant base oil in the lubricant oil composition is 50 mass % or more.

12. A method for producing the lubricant base oil according to claim 5, the method comprising a reaction step of performing an esterification reaction and/or a transesterification reaction of the alcohol compound (A) with a carboxylic acid component for deriving the structural moiety (B), wherein the carboxylic acid component for deriving the structural moiety (B) contains the monocarboxylic acid (B1) and/or an ester-forming derivative of the monocarboxylic acid (B1), and the aliphatic monocarboxylic acid (B2) and/or an ester-forming derivative of the aliphatic monocarboxylic acid (B2).

13. The method for producing the lubricant base oil according to claim 12, wherein the proportion of the structural moiety (B1) in the structural moiety (B) is 1 mol % or more and 3 mol % or less, wherein the ratio of the amount of substance (mol) of the structural moiety (B1) to the amount of substance (mol) of the structural moiety (B2) in the structural moiety (B) is 0.01 or more and 0.03 or less, wherein $R^7$ in the general formula (2) is the carboxyl group, wherein the alcohol compound (A) is pentaerythritol.

14. The method for producing the lubricant base oil according to claim 12, wherein the content of the ester compound (A) in the ester compound is 80 mass % or more and 99 mass % or less, wherein the content of the ester compound (B) in the ester compound is 1 mass % or more and 20 mass % or less.

15. The method for producing the lubricant base oil according to claim 12, wherein the content of the ester compound (A) in the ester compound is 80 mass % or more and 99 mass % or less, wherein the content of the ester compound (B) in the ester compound is 1 mass % or more and 20 mass % or less, wherein the mass ratio of the ester compound (A) to the ester compound (B) in the ester compound is 1.5 or more and 60 or less.

16. A method for producing a lubricating oil composition comprising a step of mixing 50% by mass or more of the lubricating base oil according to claim 5 with an additive selected from the group consisting of a cleanser, a dispersant, an antioxidant, an oiliness improver, a wear inhibitor, an extreme pressure agent, a rust inhibitor, a corrosion inhibitor, a metal deactivator, a viscosity index improver, a pour-point depressant, a defoamer, an emulsifier, a demulsifier, an antifungal agent, and a solid lubricant.

17. The method for producing a lubricating oil composition according to claim 16, wherein the lubricating base oil is mixed so that the content of the ester compound (A) in the lubricating oil composition is 12.5% by mass or more and 99% by mass or less.

18. The method for producing a lubricating oil composition according to claim 16, wherein the lubricating base oil is mixed so that the content of the ester compound (B) in the lubricating oil composition is 0.5% by mass or more and 75% by mass or less.

* * * * *